US011072479B1

(12) United States Patent
David

(10) Patent No.: US 11,072,479 B1
(45) Date of Patent: Jul. 27, 2021

(54) PNEUMATIC PACKAGING SYSTEM

(71) Applicant: Michael J. David, Trinity, FL (US)

(72) Inventor: Michael J. David, Trinity, FL (US)

( * ) Notice: Subject to any disclaimer, the term of this patent is extended or adjusted under 35 U.S.C. 154(b) by 459 days.

(21) Appl. No.: 15/068,710

(22) Filed: Mar. 14, 2016

(51) Int. Cl.
*B65D 81/05* (2006.01)

(52) U.S. Cl.
CPC ..... *B65D 81/052* (2013.01)

(58) Field of Classification Search
CPC ..... B65D 81/052; B65D 81/02; B65B 5/06
USPC ..... 206/521–522; 229/117.27, 87.1, 87.02; 441/88
See application file for complete search history.

(56) References Cited

U.S. PATENT DOCUMENTS 5,454,642 A * 10/1995 De Luca ..... B65D 81/052 206/522
5,954,556 A * 9/1999 Powers ..... B63C 9/155 441/108
9,889,623 B2 * 2/2018 Frayne ..... B31D 5/0073
2003/0006162 A1 * 1/2003 Smith ..... B65D 81/027 206/522
2006/0150321 A1 * 7/2006 Brockman ..... A47C 7/021 5/81.1 R
2007/0095711 A1 * 5/2007 Thompson ..... B65D 81/03 206/522
2014/0224699 A1 * 8/2014 Smith ..... B65B 5/06 206/522
2015/0183566 A1 * 7/2015 Corvisier ..... B65D 81/052 206/522
2017/0247164 A1 * 8/2017 Zhang ..... B65D 81/052

* cited by examiner

*Primary Examiner* — Anthony D Stashick
*Assistant Examiner* — Raven Collins
(74) *Attorney, Agent, or Firm* — Lewellyn Law, PLLC; Stephen Lewellyn

(57) ABSTRACT

A container in a rectilinear configuration has an interior surface, an exterior surface, and a plurality of planar sections. A plurality of pneumatic panels are attached to at least some of the sections. A control assembly has a first member to indicate when the pneumatic panels are inflated, a second member to deflate the pneumatic panels, and a valve to receive pressurized air from a source to inflate the pneumatic panels.

1 Claim, 4 Drawing Sheets

FIG. 1
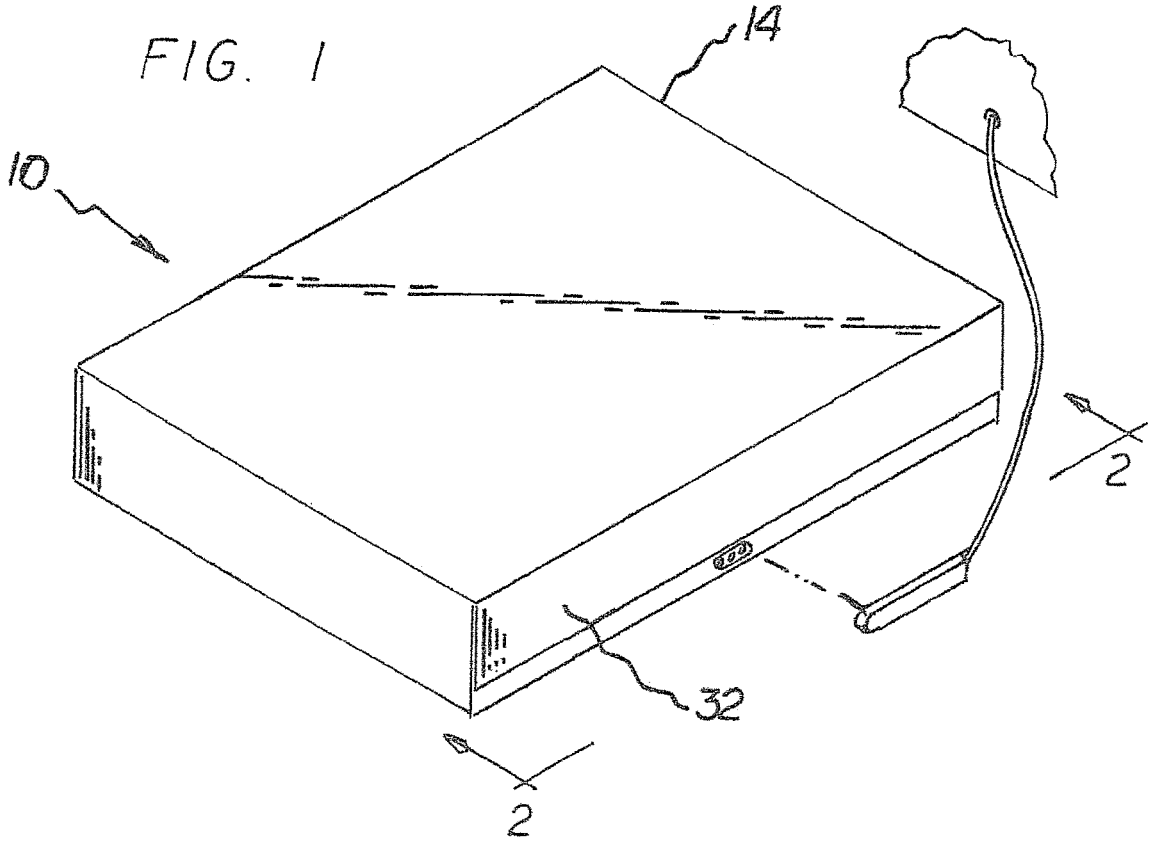
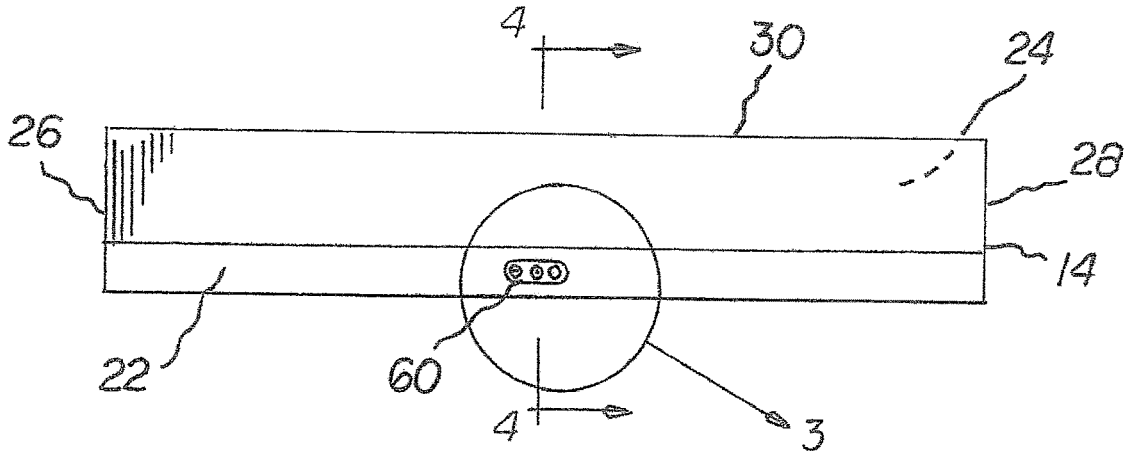
FIG. 2

FIG. 5
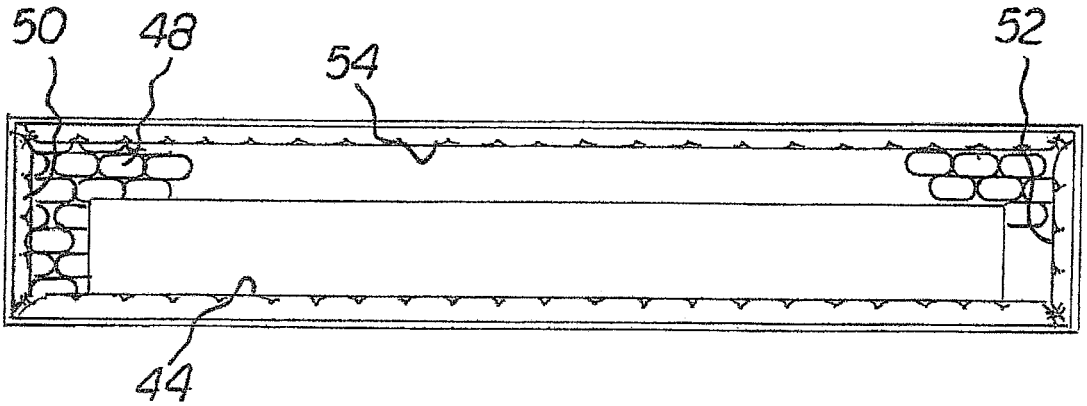
FIG. 6
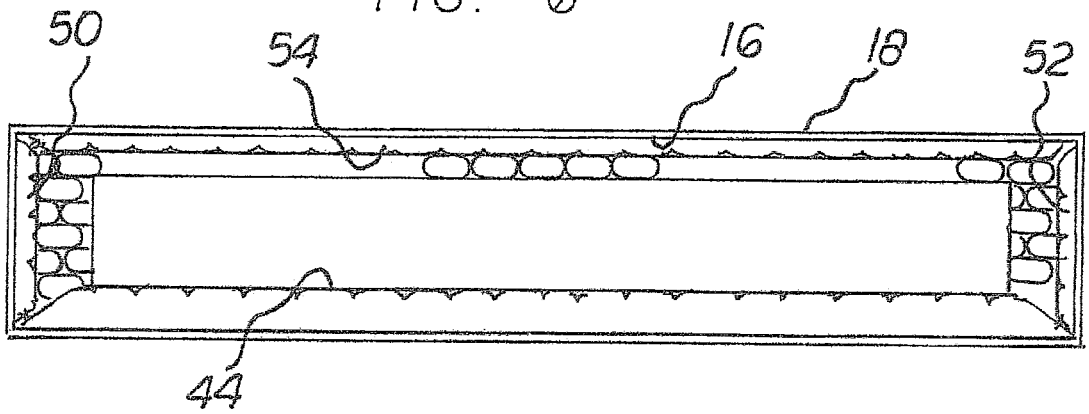
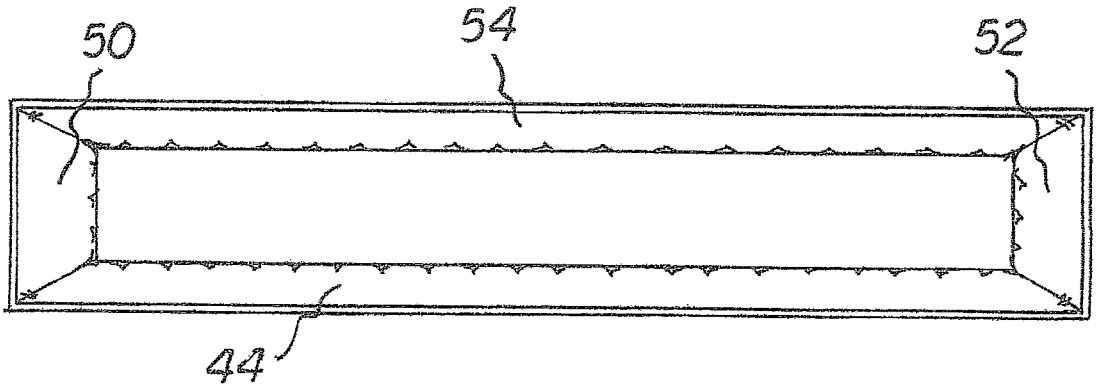
FIG. 7

FIG. 8
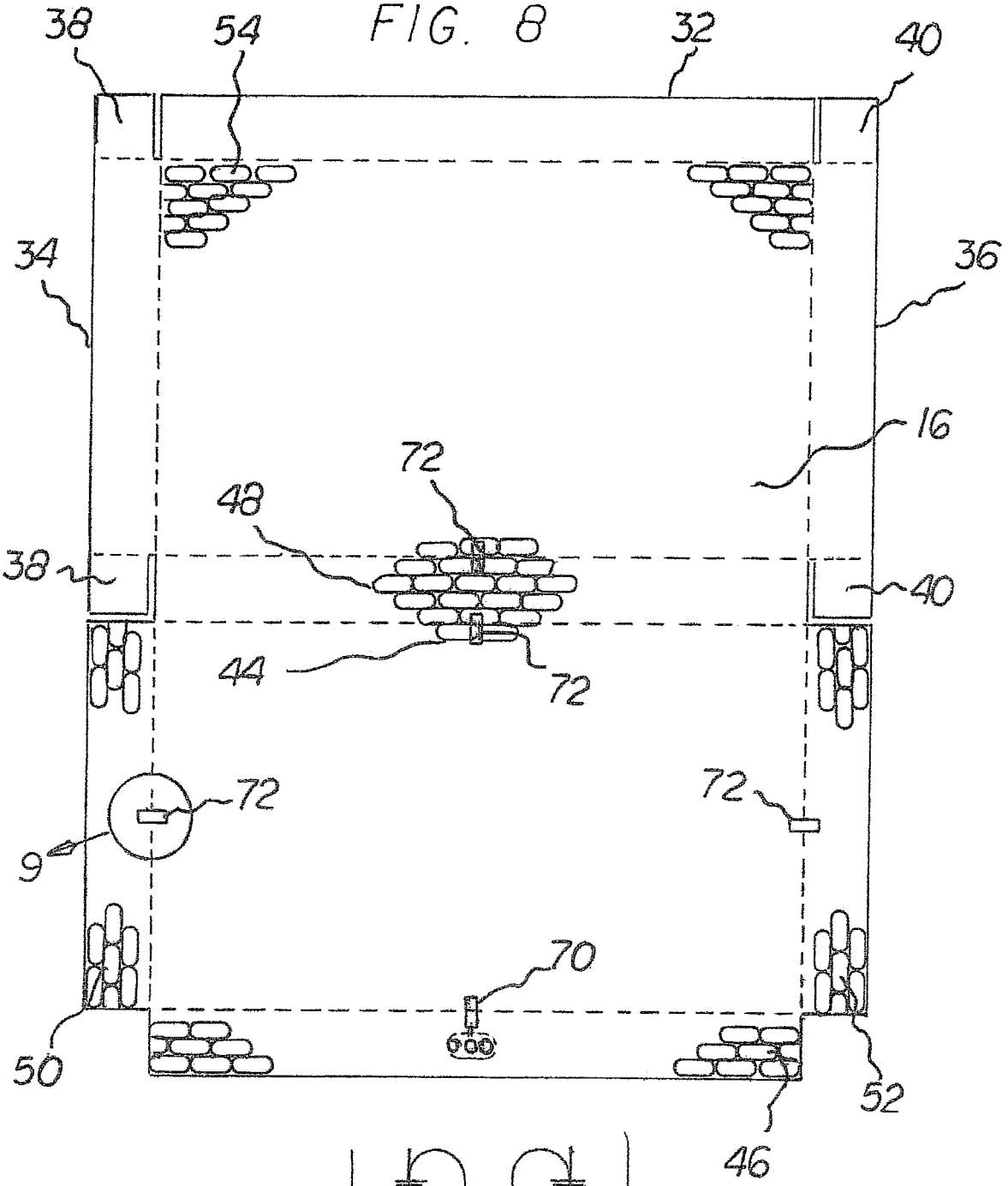
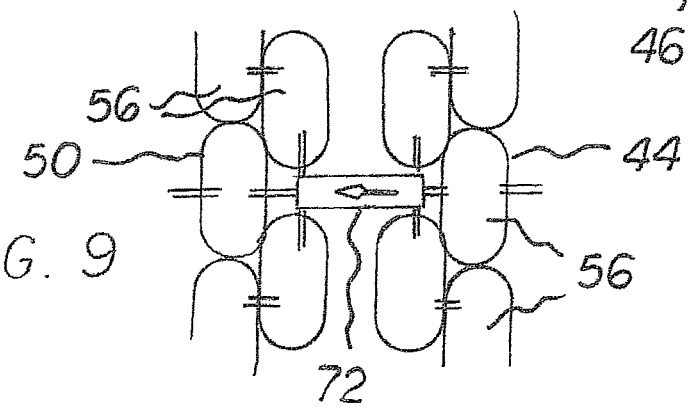
FIG. 9

PNEUMATIC PACKAGING SYSTEM

BACKGROUND OF THE INVENTION

Field of the Invention

The present invention relates to a pneumatic packaging system and more particularly pertains to removably receiving an object to be mailed, sequentially inflating pneumatic panels to secure the received object, and deflating the pneumatic panels before removing the secured object.

Description of the Prior Art

The use of packing devices is known in the prior art. More specifically, packing devices previously devised and utilized for the purpose of packaging objects are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, they do not describe a pneumatic packaging system that allows removably receiving an object to be mailed, sequentially inflating pneumatic panels to secure the object, and deflating the pneumatic panels before removing the object.

In this respect, the pneumatic packaging system according to the present invention substantially departs from the conventional concepts and designs of the prior art, and in doing so provides an apparatus primarily developed for the purpose of removably receiving an object to be mailed, sequentially inflating pneumatic panels to secure the object, and deflating the pneumatic panels before removing the object.

Therefore, it can be appreciated that there exists a continuing need for a new and improved pneumatic packaging system which can be used for removably receiving an object to be mailed, sequentially inflating pneumatic panels to secure the object, and deflating the pneumatic panels before removing the object. In this regard, the present invention substantially fulfills this need.

SUMMARY OF THE INVENTION

In view of the disadvantages inherent in the known types of packing devices now present in the prior art, the present invention provides an improved pneumatic packaging system. As such, the general purpose of the present invention, which will be described subsequently in greater detail, is to provide a new and improved pneumatic packaging system and method which has all the advantages of the prior art and none of the disadvantages.

To attain this, the present invention essentially comprises a container in a rectilinear configuration with an interior surface, an exterior surface, and a plurality of planar sections. A plurality of pneumatic panels are attached to at least some of the planar sections. A control assembly includes a first member adapted to indicate when the pneumatic panels are inflated, a second member adapted to deflate the pneumatic panels, and a valve adapted to receive pressurized air from a source to inflate the pneumatic panels.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of packing devices, structures, methods, and systems for carrying out the several purposes of the present invention. It is important, therefore, that the invention be regarded as including such equivalent constructions insofar as they do not depart from the spirit and scope of the present invention.

It is therefore an object of the present invention to provide a new and improved pneumatic packaging system which has all of the advantages of the prior art packing systems of known designs and configurations and none of the disadvantages.

It is another object of the present invention to provide a new and improved pneumatic packaging system which may be easily and efficiently manufactured and marketed.

It is further object of the present invention to provide a new and improved pneumatic packaging system which is of durable and reliable constructions.

An even further object of the present invention is to provide a new and improved pneumatic packaging system which is susceptible of a low cost of manufacture with regard to both materials and labor, and which accordingly is then susceptible of low prices of sale to the consuming public, thereby making such pneumatic packaging system economically available to the buying public.

Lastly, it is an object of the present invention to provide a pneumatic packaging system for removably receiving an object to be mailed, sequentially inflating pneumatic panels to secure the object, and deflating the pneumatic panels before removing the object. The receiving, inflating, securing, deflating, and removing are done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of a pneumatic packaging system constructed in accordance with the principles of the present invention.

FIG. 2 is a front elevational view taken along line 2-2 of FIG. 1.

FIG. 5 is a cross sectional view through the container showing the first pneumatic panel partially inflated.

FIG. 6 is a cross sectional view similar to FIG. 5 but showing the first pneumatic panel fully inflated and with the third, fourth, fifth and sixth pneumatic panels partially inflated.

FIG. 7 is a cross sectional view similar to FIG. 6 but with all of the pneumatic panels fully inflated.

FIG. 8 is a plan view of the container in a flat configuration prior to folding to a rectilinear configuration and prior to inflation of the pneumatic panels.

FIG. 9 is an enlarged showing of one of the valves taken at Circle 9 of FIG. 8.

The same reference numerals refer to the same parts throughout the various Figures.

DESCRIPTION OF THE PREFERRED EMBODIMENT

Figure 3:
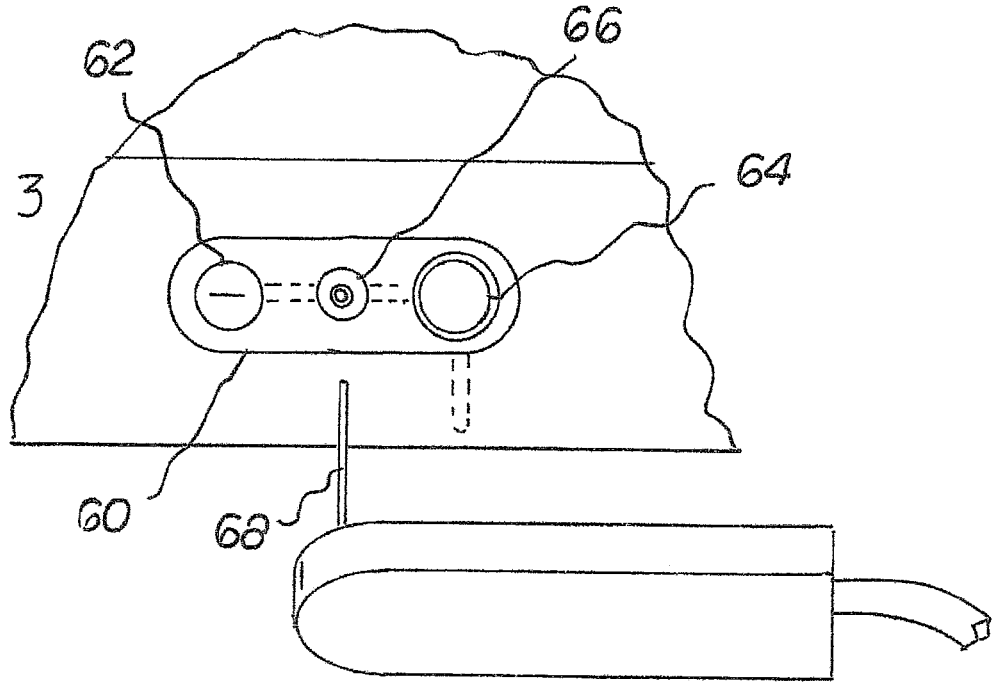
FIG. 3 is an enlarged showing taken at circle 3 of FIG. 2.

With reference now to the drawings, and in particular to FIG. 1 thereof, the preferred embodiment of the new and improved pneumatic packaging system embodying the principles and concepts of the present invention and generally designated by the reference numeral 10 will be described.

The present invention, the pneumatic packaging system 10 is comprised of a plurality of components. Such components in their broadest context include a container, pneumatic panels, and a control assembly. Such components are individually configured and correlated with respect to each other so as to attain the desired objective.

from a specific standpoint, the preferred embodiment of the pneumatic packaging system, designated by reference numeral 10 is for removably receiving an object to be mailed, for sequentially inflating pneumatic panels to secure the received object, and for deflating the pneumatic panels before removing the secured object. The receiving, inflating, securing, deflating, and removing are done in a safe, convenient, and economical manner.

The system includes a container 14 fabricated of cardboard. the container is in a planar configuration prior to folding and in a rectilinear configuration for use after folding. The container has an interior surface 16 and an exterior surface 18.

The container has a bottom section 20 with an attached first front section 22, a rear section 24, a first side section 26, and a second side section 28.

The container has a top section 30 with a second front section 32, a third side section 34, and a fourth side section 36. Two side tabs 38 are attached to the third side section. Two side tabs 40 are attached to the fourth side section.

A plurality of pneumatic panels are provided. The pneumatic panels include a first pneumatic panel 44 attached to the bottom section, a second pneumatic panel 46 attached to the first front section, a third pneumatic panel 48 attached to the rear section, a fourth pneumatic panel 50 attached to the first side section, a fifth pneumatic panel 52 attached to the second side section, and a sixth pneumatic panel 54 attached to the top section. Each of the pneumatic panels is formed of completely pneumatically interconnected small bubbles 56. The container is folded into a rectilinear configuration with the top and bottom sections being horizontally oriented and the first front section, the second front section, the rear section, and side sections being vertically oriented. A chamber is formed between the pneumatic panels for receiving an object to be secured by the pneumatic panels when inflated.

A control assembly 60 is next provided. The control assembly is on the first front section. The control assembly includes an air bubble 62 adapted to bulge outwardly to indicate when the pneumatic panels are inflated. A deflation button 64 is provided and is adapted to be depressed to deflate the pneumatic panels when opening the container.

The control assembly includes a first valve 66 adapted to receive pressurized air from a source 68 to inflate the second pneumatic panel. The source of pressurized air is illustrated as a fixed pump. Such source, however, could readily be a handheld pump or a pump built into the container. A second valve 70 pneumatically couples the second pneumatic panel to the first pneumatic panel. The second valve has a first activation pressure point to allow the filling of the first pneumatic panel when the second pneumatic panel reaches the first activation pressure point. A plurality of third valves 72 is provided. The third valves pneumatically couple the second pneumatic panel to the third and fourth and fifth pneumatic panels and pneumatically couple the third and sixth pneumatic panels. The third pneumatic valves have a second activation pressure point greater than the first activation point to allow the filling of the third, fourth, fifth and sixth pneumatic panels after the first pneumatic panel reaches the second activation pressure point.

Figure 4:
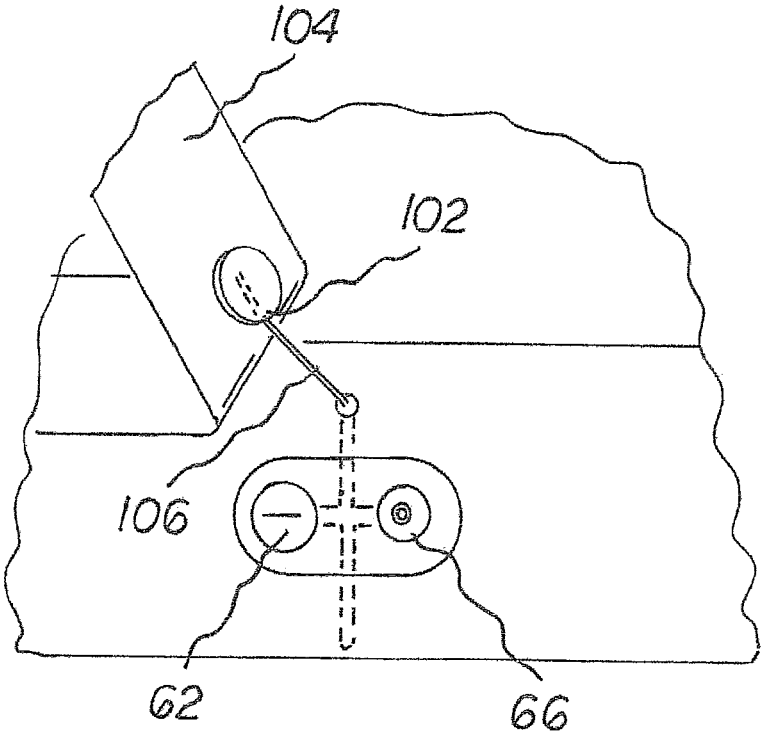
FIG. 4 is a cross sectional view taken along line 4-4 of FIG. 2 but illustrating alternate mechanisms for deflating the pneumatic panels.

As may be readily seen in FIG. 9, the inflatable elements are connected to adjacent inflatable elements through short tubular connectors of reduced diameter. Further, as best seen in FIGS. 3 and 4, the control assembly includes first and second valves. The first valve is coupled to an adjacent panel for inflation. The second valve is coupled to an adjacent panel for deflation.

An alternate embodiment of the invention is illustrated in FIG. 4. In such embodiment of the system 100, the second member 102 of the control assembly includes a pull strip 104 and a string 106 between the container and the pull strip. The pull strip is adapted to be pulled to deflate the pneumatic panels and open the container.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pneumatic packaging system (10) for removably receiving an object to be mailed, for sequentially inflating pneumatic panels to secure the object, and for deflating the pneumatic panels before removing the object, the system comprising, in combination:

a container (14) fabricated of cardboard, the container being in a planar configuration prior to folding and in a rectilinear configuration for use after folding, the container having an interior surface (16) and an exterior surface (18);

the container having a bottom section (20) with an attached first front section (22), a rear section (24), a first side section (26), and a second side section (28);

the container having a top section (30) with a second front section (32), a third side section (34), and a fourth side section (36), two side tabs (38) attached to the third side section, two side tabs (40) attached to the fourth side section;

a plurality of pneumatic panels including a first pneumatic panel (44) positioned adjacent to the bottom section, a second pneumatic panel (46) positioned adjacent to the first front section, a third pneumatic panel (48) positioned adjacent to the rear section, a fourth pneumatic panel (50) positioned adjacent to the first side section, a fifth pneumatic panel (52) positioned adjacent to the second side section, and a sixth pneumatic panel (54) positioned adjacent to the top section, each of the pneumatic panels being formed of completely pneumatically interconnected small bubbles (56), the container being folded into a rectilinear configuration a control assembly (60) on the first front section, the control assembly including an air bubble (62) adapted to bulge outwardly to indicate when the pneumatic panels are inflated, a deflation button (64) controlled by the user adapted to be depressed to deflate the pneumatic panels when opening the container, and a first valve (66) adapted to receive pressurized air from a source (68) to inflate the second pneumatic panel, a second valve (70) pneumatically coupling the second pneumatic panel to the first pneumatic panel, the second valve having a first passageway adapted to allow the inflating and deflating of the first pneumatic panel, the second valve having a first activation pressure point to allow the filling of the first pneumatic panel when the second pneumatic panel reaches the first activation pressure point, a plurality of third valve (72) pneumatically coupling the second pneumatic panel to the third and fourth and fifth pneumatic panels and pneumatically coupling the third and sixth pneumatic panels, the third members having a second passageway adapted to allow the inflating and deflating of the third, fourth, fifth and sixth pneumatic panels, the third pneumatic valves have a second activation pressure point greater than the first activation point, the sections of the container and the plurality of pneumatic panels being positioned in a planar configuration for storage and transportation purposes prior to assembly and use.

* * * * *